US005210582A

United States Patent [19]

Lundy et al.

[11] Patent Number: 5,210,582

[45] Date of Patent: May 11, 1993

[54] STRETCHABLE CLEANER BAND DISTURBER

[75] Inventors: Douglas A. Lundy, Webster; Kenneth S. Palumbo, Rochester; Robert E. Rosdahl, Jr., Webster, all of N.Y.

[73] Assignee: Xerox Corporation, Stamford, Conn.

[21] Appl. No.: 941,279

[22] Filed: Sep. 4, 1992

[51] Int. Cl.[5] ..... G03G 21/00

[52] U.S. Cl. ..... 355/297; 355/296; 355/298; 355/301; 15/256.51; 15/256.52

[58] Field of Search ..... 355/296, 297, 298, 300, 355/301, 302; 118/652; 15/256.51, 256.52, 256.5

[56] References Cited

U.S. PATENT DOCUMENTS 4,134,673 1/1979 Fisher ..... 355/301
4,989,047 1/1991 Jugle et al. ..... 355/297
5,128,725 7/1992 Frankel et al. ..... 355/301
5,151,744 9/1992 Lundy et al. ..... 355/296
5,153,658 10/1992 Lundy et al. ..... 355/301

FOREIGN PATENT DOCUMENTS 0186776 10/1983 Japan ..... 355/301
0186778 10/1983 Japan ..... 355/301

*Primary Examiner*—A. T. Grimley
*Assistant Examiner*—Matthew S. Smith

[57] ABSTRACT

A cleaner band stretchably disposed, across the imaging surface width, between two rotating cleaner brushes. The cleaner band is slightly off center and down process from the brush backup roll. The cleaner band acts as a disturber for dislodging large agglomerate residual particles from the imaging surface.

8 Claims, 4 Drawing Sheets

STRETCHABLE CLEANER BAND DISTURBER

BACKGROUND OF THE INVENTION

This invention relates generally to an electrostatographic printer and copier, and more particularly, concerns a cleaning apparatus for removal of residual particles and agglomerates from the imaging surface.

In an electrophotographic application such as xerography, a charge retentive surface is electrostatically charged, and exposed to a light pattern of an original image to be reproduced to selectively discharge the surface in accordance therewith. The resulting pattern of charged and discharged areas on that surface from an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charge surface may be imagewise discharged in a variety of ways. Ion projection devices, where a charge is imagewise deposited on a charge retentive substrate, operate similarly.

Although a preponderance of the toner forming the image is transferred to the paper during transfer some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom.

A commercially successful mode of cleaning employed on automatic xerographic devices utilizes a brush with soft conductive fiber bristles which have suitable triboelectric characteristics. While the bristles are soft they are sufficiently firm to remove residual toner particles from the charge retentive surface. A voltage is applied to the fibers to enhance removal of toner from the charge retentive surface.

Not all toner and debris is removed from the surface by the brush cleaner. For reasons that are unclear, toner particles agglomerate with themselves and with certain types of debris to form a spot-wise deposition that can eventually strongly adhere to the charge retentive surface. These spots range from 50 micrometers to greater than 400 micrometers in diameter and 5 to 25 micrometers in thickness, but typically are about 200 micrometers in diameter and 5 to 15 micrometers in thickness. The agglomerates range in material compositions from nothing but toner to abroad assortment of plastics and debris from paper. The spots cause a copy quality defect showing up as a black spot on a background area of the copy which is the same size as the spot on the photoreceptor. The spot on the copy varies slightly with the exact machine operating conditions, that cannot be deleted by control of the machine process characteristics.

While attempts were made to eliminate the agglomerate spotting by controlling of extraneous debris within the device this solution has been found difficult if not impossible to implement. Additionally, there was no way to eliminate the formation of agglomerates that the toner formed itself. However, in studying the formation of these spots, it was noted that the spots appeared instantaneously on the charge retentive surface, i.e., the spots were not the result of a continuing nucleation process. It was subsequently noted that newer deposited spots were more weakly adhered to the surface than older spots.

The following disclosure may be relevant to various aspects of the present invention and may be briefly summarized as follows:

U.S. Pat. No. 4,989,047 to Jugle et al. discloses a cleaning apparatus for an electrophotographic printer that reduces agglomeration-caused spotting on the imaging surface. A secondary cleaning member, characterized as a thin scraper blade, is arranged at a low angle of attack, with respect to the imaging surface, to allow a maximum shearing force to be applied by the blade to the agglomerates for removal thereof.

SUMMARY OF INVENTION

Briefly stated, and in accordance with one aspect of the present invention, there is provided an apparatus for removing residual particles from a moving imaging surface. The apparatus comprises a housing defining an open ended chamber and a pair of cleaner brushes, disposed in the chamber of the housing with a portion of each cleaner brush extending outwardly from the open end of the chamber of the housing into engagement with the imaging surface. Means, interposed between the cleaner brushes, for disturbing the residual particles, the disturbing means having a tension force applied there to traverse to the direction of movement of the imaging surface in a plane substantially parallel to the imaging surface.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 5:
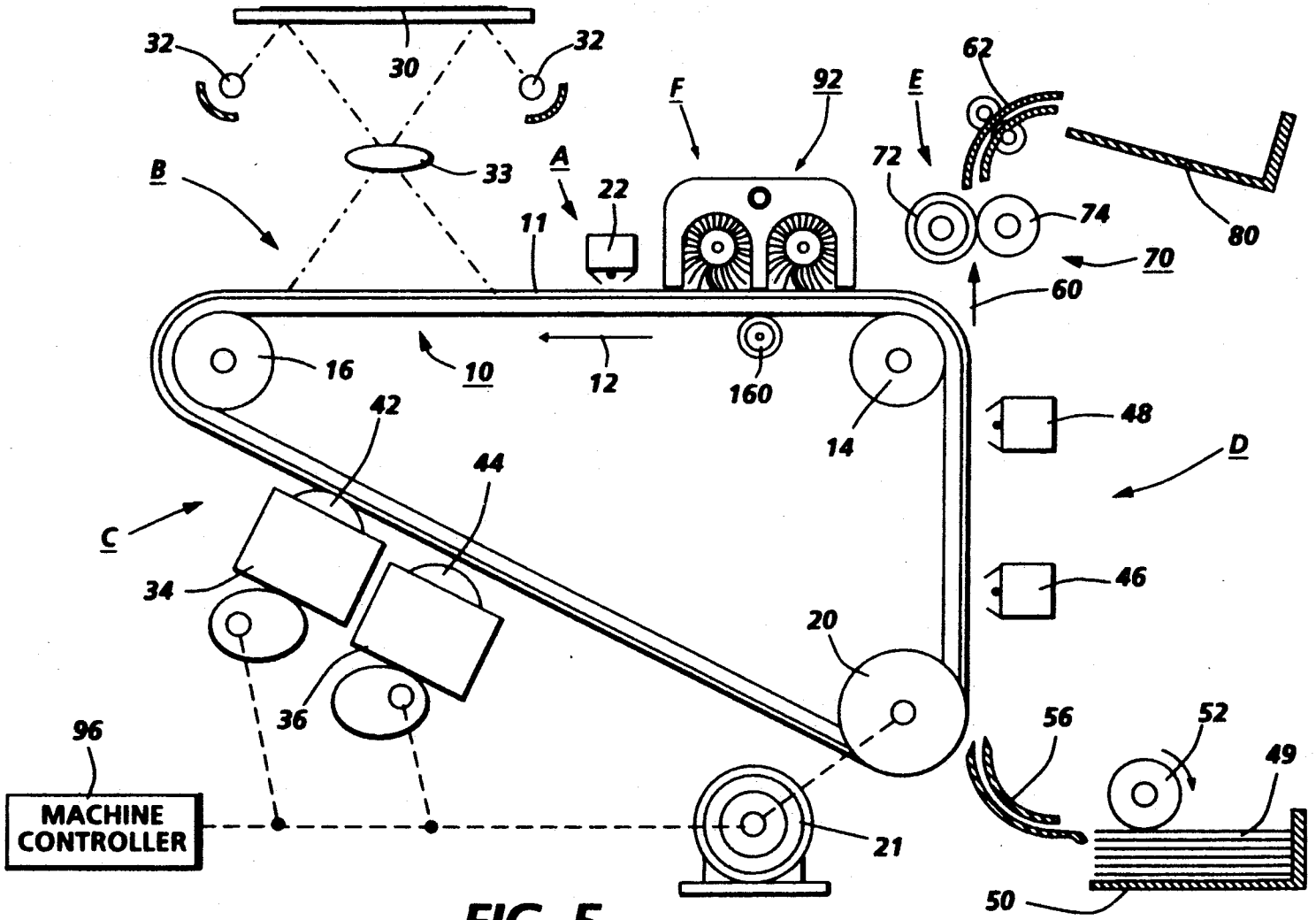
FIG. 5 is a schematic illustration of a printing apparatus incorporating the inventive features of the invention.

For a general understanding of an electrophotographic printer or copier in which the present invention may be incorporated, reference is made to FIG. 5 which depicts schematically the various components thereof. Hereinafter, like reference numerals will be employed throughout to designate identical elements. Although the dual brush cleaner with a cleaner band disturber apparatus of the present invention is particularly well adapted for use in an electrophotographic printing machine, it should become evident from the following discussion, that it is equally well suited for use in other applications and is not necessarily limited to the particular embodiments shown herein.

Referring now to the drawings, the various processing stations employed in the reproduction machine illustrated in FIG. 5 will be described briefly hereinafter. It will no doubt be appreciated that the various processing elements also find advantageous use in electrophotographic printing applications from an electronically stored original, and with appropriate modifications, to an ion projection device which deposits ions in image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance successive portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 5, initially a portion of the belt 10 passes through charging station A. At charging station A, a corona device 22 charges a portion of the photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto the charged portion of the photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, the belt 10 advances the electrostatic latent image to development station C. At development station C, one of at least two developer housings 34 and 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed latent image to transfer station D. At transfer station D, a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, a corona generator 48 charges the copy sheet to an opposite polarity to detack the copy sheet from the belt 10, whereupon the sheet is stripped from the belt 10 at stripping roller 14.

Sheets of support material 49 are advanced to transfer station D from a supply tray 50. Sheets are fed from tray 50 with sheet feeder 52, and advanced to transfer station D along conveyor 56.

After transfer, the sheet continues to move in the direction of arrow 60 to fusing station E. Fusing station E includes a fuser assembly, indicated generally by the reference numeral 70, which permanently affixes the transferred toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a shoot 62 to an output 80 or finisher.

Residual particles, remaining on the photoreceptor belt 10 after each copy is made, may be removed at cleaning station F. The cleaning apparatus of the present invention is represented by the reference numeral 92. Removed residual particles may also be stored for disposal.

A machine controller 96 is preferably a known programmable controller or combination of controllers, which conventionally control all the machine steps and functions described above. The controller 96 is responsive to a variety of sensing devices to enhance control of the machine, and also provides connection of diagnostic operations to a user interface (not shown) where required.

As thus described, a reproduction machine in accordance with the present invention may be any of several well known devices. Variations may be expected in specific electrophotographic processing, paper handling and control arrangements without affecting the present invention. However, it is believed that the foregoing description is sufficient for purposes of the present application to illustrate the general operation of an electrophotographic printing machine which exemplifies one type of apparatus employing the present invention therein. Reference is now made to FIGS. 1 through 4 where the showings are for the purpose of illustrating a preferred embodiment of the invention and not for limiting the same.

Figure 1:
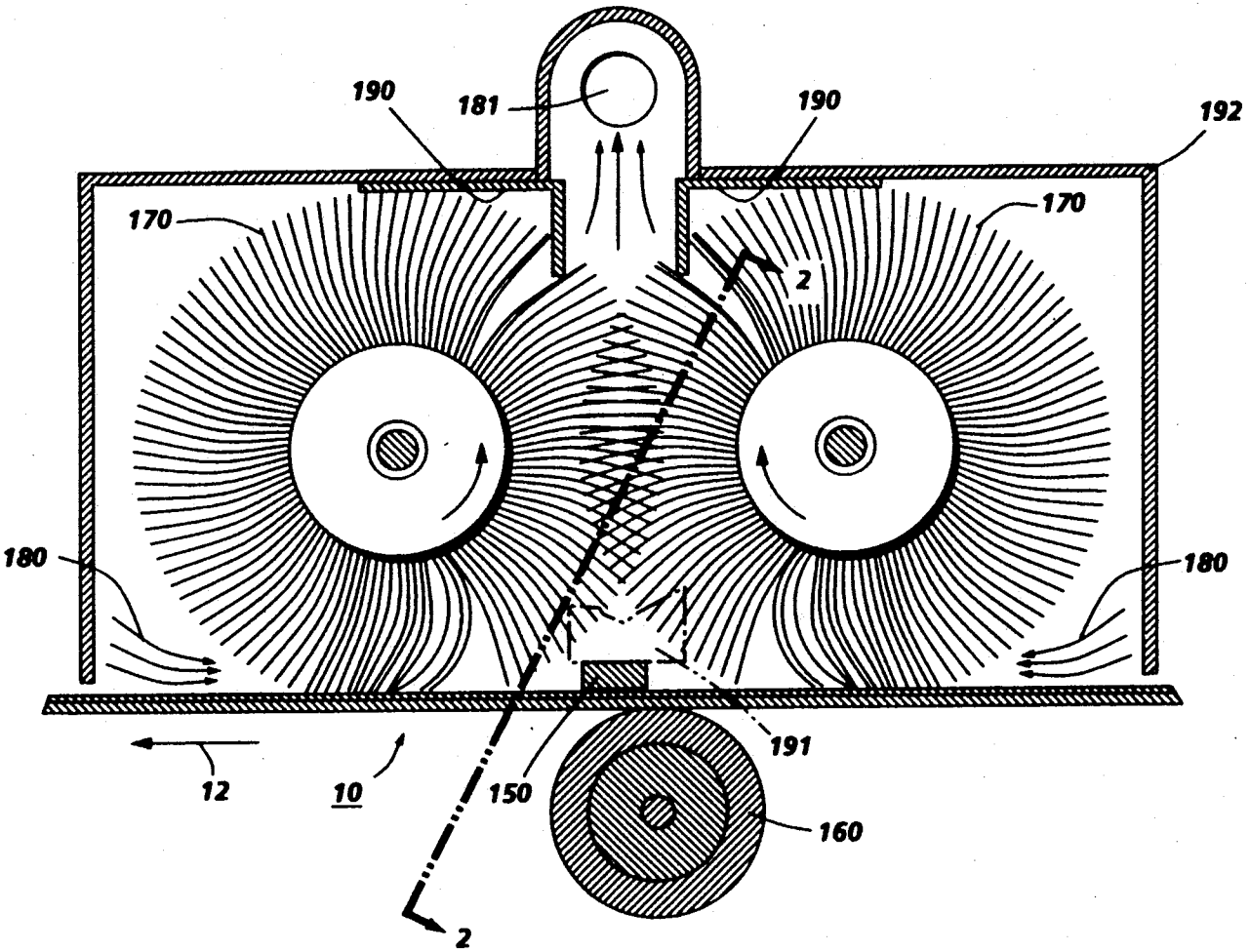
FIG. 1 is a schematic elevational view of the present invention showing the cleaner band positioned between two cleaning brushes.

Referring to FIG. 1 which shows a dual cleaning brush system with the present invention of a cleaner band incorporated therein. The cleaner band 150 is stretchably disposed across the width of the photoreceptor surface 11 perpendicular to the process direction. The cleaner band 150 is attached to the center foot 191 on opposite sides of the housing, in a parallel position to the photoreceptor, just above the photoreceptor surface 11, between the two rotating insulative cleaning brushes 170. The cleaner band 150 is further positioned slightly off center and down process from the cleaner brush backup roll 160. The backup roll 160 is located on the opposite side of the photoceptor 10 from the cleaner band 150. Mounting the cleaner band 150 between the rotating brushes provides continuous cleaning of the contact edge of the cleaner band 150. Positioning the band 150 just past the backup roll 160 provides positive edge contact and band loading. The cleaning brushes 170 are positioned such that one brush 170 is located behind the other in the direction of movement of the photoreceptor 10 indicated by the arrow 12. The dual brushes 170 rotate, in opposite directions to each other, against the photoreceptor surface 11. Air is pulled through the brush fibers by a vacuum 181 to remove residual particles loosened by the brush 170 rotation against the photoreceptor surface 11 and the residual particles released by contact of the brushes 170 with the flicker bars 190. The dual brush cleaning system described above is enclosed in a cleaner housing 192.

Figure 2:
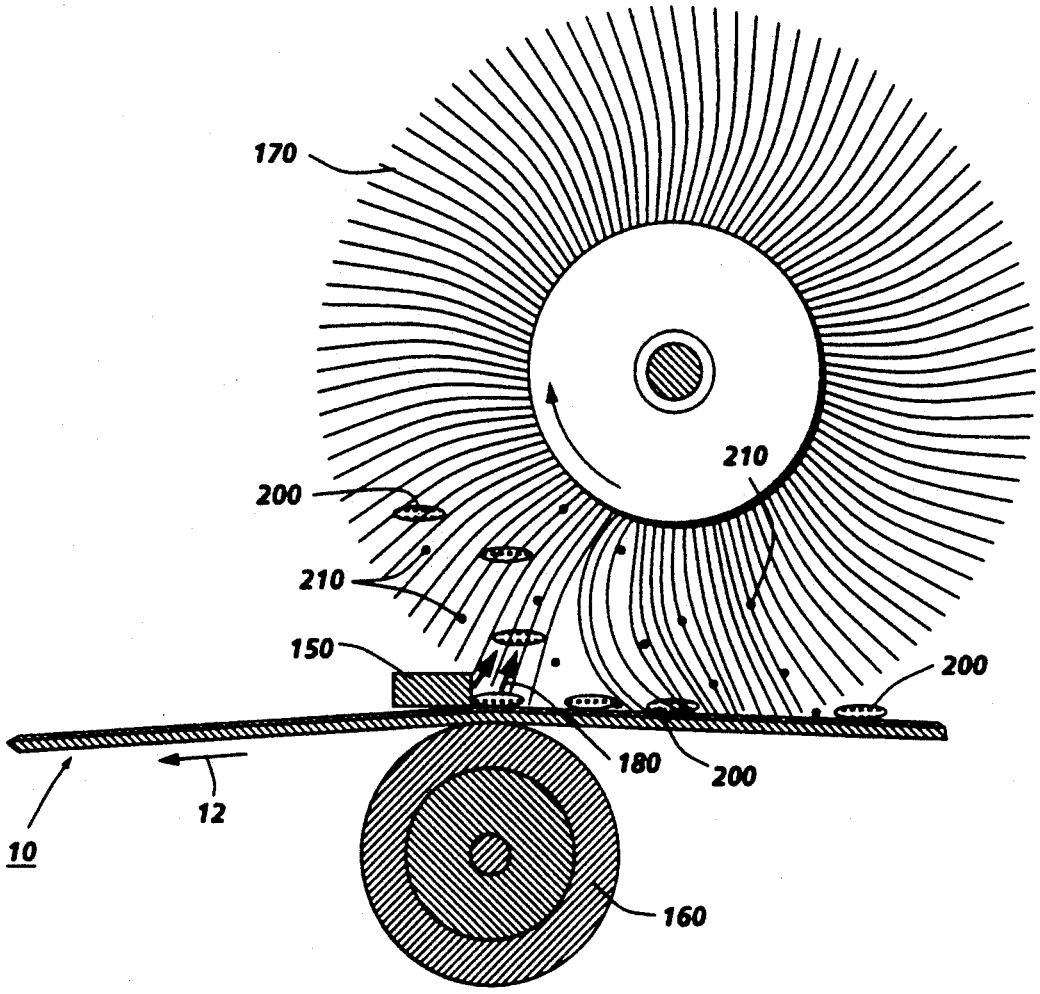
FIG. 2 is a sectional elevational view taken along the line in the direction of the arrows 2—2 in FIG. 1.

Referring to FIG. 2 which shows an enlargement of section 2—2 from FIG. 1. The cleaner brush 170, located upstream from the second cleaner brush (not shown), removes toner 210 and residual particle agglomerates 200 (i.e. contaminants) from the photoreceptor 10 as it makes frictional contact with the photoreceptor 10. The residual particles (200, 210) removed by the brush 170 are removed from the brush fibers by airflow 180. Some of the agglomerates 200 are not removed by the cleaner brush and thus, remain on the photoreceptor 10. The backup roll 160 pushes the photoreceptor 10 into contact with an edge of the cleaner band 150. (The cleaner band edge and the photoreceptor surface form a 90° angle when in contact with each other). The edge of the cleaner band 150 then acts a passive disturber, that slides and bumps loose agglomerates 200 (large particles), as the photoreceptor 10 rotates in the direction of arrow 12, before these agglomerates 200 are impacted on the photoreceptor (i.e. creating spots). The loosened agglomerates 200 are then removed by the airflow 180 or by the second cleaner brush (shown in FIG. 1). The cleaner band is resilient strip of material (e.g. polyurethane, halogenated elastomers, polystyrenes, rubbers, polymethacrylates, polyacrylates, polybutadienes, substituted rubbers, akylenes and polyvinyl halides).

Through testing, a critical dimension of the cleaner band 150 was determined. This critical parameter requires that the band width be two or three times wider than it's thickness. Having a band, with a width two to three times wider than the band thickness, prevents the band from rolling over and twisting and thus, allows consistent application of a crisp, firm band edge against the imaging surface to knock off agglomerations from the imaging surface.

Figure 3:
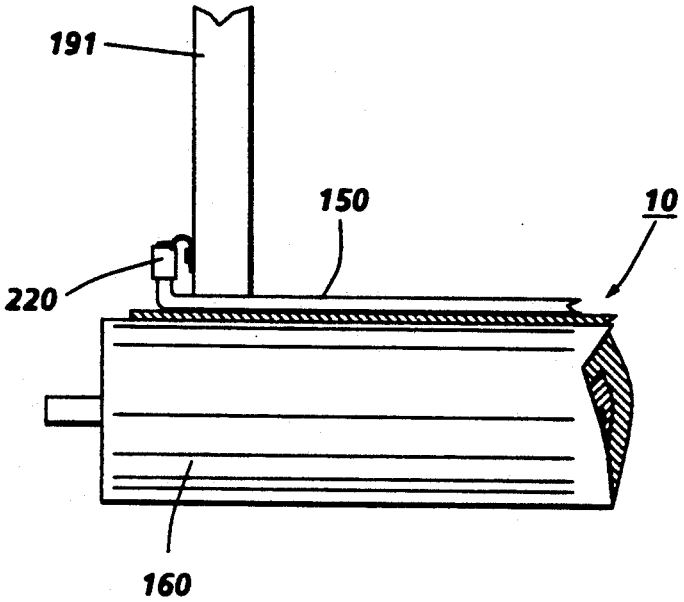
FIG. 3 is an enlarged, side elevational view of the electrical eyelet fastening to the housing.

Referring to FIG. 3, which shows a side view of one way in which the cleaner band 250 can be mounted to the cleaner housing. One each end of the cleaner band 150, an electrical eyelet 220 is crimped. The cleaner band 150 is stretched over the photoreceptor width and connected by the electrical eyelets 220 to the opposite sidewalls of the cleaner housing at the center foot 191. The cleaner band 150 has only enough tension force applied thereto to keep the cleaner band 150 stable and in place just above the photoreceptor 10.

Figure 4:
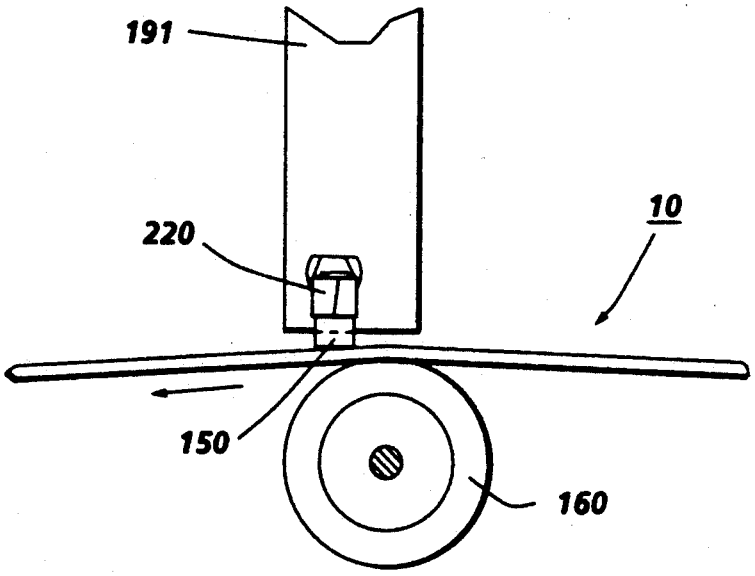
FIG. 4 is an enlarged front elevational view of the cleaner band being positioned slightly off center and downstream from the backup roll.

Referring to FIG. 4 which shows a frontal view of the cleaner band 150 attached to the cleaner housing center foot 191. As shown in FIG. 3 the electrical eyelet 220 fastens on the outside surface of the housing wall. In FIG. 4, the electrical eyelets fasten to the opposite sidewalls of the housing center foot 191.

In recapitulation, it is evident that the cleaning band disturber is stretchably disposed across the photoreceptor surface perpendicular to the process direction and just above the photoreceptor surface between two rotating cleaning brushes. The backup roll brings the photoreceptor surface in contact with the cleaner band thus, allowing the cleaner band to act as a passive bumper to dislodge large agglomerates from the photoreceptor surface before they are impacted on the photoreceptor surface. The cleaner band has a critical dimension that requires the band width to be two to three times wider than its thickness. The cleaner band is fastened to the center foot of the housing, located on opposite side walls of the cleaner housing, with just enough tension force to keep the cleaner band in place just above the photoreceptor.

It is, therefore, apparent that there has been provided in accordance with the present invention, a stretchable cleaner band disturber that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing residual particles from a moving imaging surface, comprising:

a housing defining an open ended chamber;

a pair of cleaner brushes, disposed in the chamber of said housing with a portion of each cleaner brush extending outwardly from the open end of the chamber of the housing into engagement with the imaging surface; and means, interposed between said cleaner brushes, for disturbing the residual particles, said disturbing means having a tension force applied thereto in a direction transverse to the direction of movement of the imaging surface in a plane substantially parallel to the imaging surface.

2. An apparatus as recited in claim 1, wherein said disturbing means comprises a cleaner band.

3. An apparatus as recited in claim 2, wherein said cleaner band comprises a generally planar surface contacting the imaging surface and extending there across in a direction transverse to the direction of movement of the imaging surface.

4. An apparatus as recited in claim 2, wherein said cleaner band comprises a resilient strip.

5. An apparatus as recited in claim 4, wherein said resilient strip is made from an elastomeric material.

6. An apparatus as recited in claim 4, wherein said resilient strip is selected from the group of materials consisting of polyurethanes, halogenated elastomers, polystyrenes, rubbers, polymethacrylates, polyacrylates, polybutadienes, substituted rubbers, alkylenes and polyvinyl halides.

7. An apparatus as recited in claim 4, wherein said cleaner band comprises a pair of eyelets with one of said eyelets being mounted in one marginal end region of said resilient strip and the other of said eyelets, being mounted in the other marginal end region of said resilient strip, said cleaner band being adapted to be mounted at least partially in the chamber of said housing with said pair of eyelets releasably attached thereto so as to stretch said resilient strip.

8. An apparatus as recited in claim 2, further comprises a backup roll with said imaging surface being interposed between said backup roll and said cleaner band.

* * * * *